United States Patent [19]

Burnham

[11] 4,045,828

[45] Sept. 6, 1977

[54] FEMALE URINAL APPARATUS

[76] Inventor: Emily A. Burnham, P.O. Box 246, Enterprise, Utah 84725

[21] Appl. No.: 656,065

[22] Filed: Feb. 6, 1976

[51] Int. Cl.[2] ..... A47K 11/00; A61G 9/00; E03D 13/00

[52] U.S. Cl. ..... 4/110

[58] Field of Search ..... 4/110, 111, 112, 113, 4/142

[56] References Cited

U.S. PATENT DOCUMENTS

| | | | |
|---|---|---|---|
| 3,030,636 | 4/1962 | Evans | 4/110 |
| 3,423,866 | 3/1969 | Schwartz | 4/110 |
| 3,725,962 | 4/1973 | Gouget | 4/110 |
| 3,727,244 | 4/1973 | Collins | 4/110 |

*Primary Examiner*—Robert I. Smith
*Attorney, Agent, or Firm*—H. Gordon Shields

[57] ABSTRACT

Female urinal apparatus is disclosed which comprises a container adapted for use by a recumbent female, such as for hospital or home nursing applications.

3 Claims, 3 Drawing Figures

FEMALE URINAL APPARATUS

BACKGROUND OF THE INVENTION

1. Field of the Invention

This invention pertains to urinals, and more particularly, to urinals designed to conform to the female anatomy for use by recumbent females.

2. Description of the Prior Art

Anatomical differences between males and females require different types of urinal apparatus, particularly when users are in the recumbent or supine position. The relative simplicity of the male anatomy has allowed for the development of urinal apparatus which is well suited for use by males when in the recumbent or supine position. However, the relative complexity of the female anatomy has resulted in the development of many types of female urinal apparatus, none of which is in widespread use today. This is contrasted with the well-known male urinals in widespread use in hospitals, convalescent homes, and rest homes. However, over the years different types of urinal apparatus have been developed for use by females in the recumbent position. Several examples of such apparatus will be briefly discussed.

U.S. Pat. No. 661,403 (Hogan) discloses female urinal apparatus with a relatively wide inverted T shaped mouth, or opening. The entire configuration of the apparatus is generally that of an inverted and somewhat elongated T. The flat bottom of the apparatus allows it to be placed on a bed between the legs of the user and the configuration of the apparatus, and particularly the mouth or opening of the apparatus, is adapted for use by females in the recumbent position.

A later patent, U.S. Pat. No. 805,312 (Meinecke) discloses a circular opening extending into a container which includes a generally flat bottom and an adjacent flat side which allows the apparatus to be stable in either an upright position or a sideways position.

U.S. Pat. No. 2,490,969 (Kinyon) is a urinal drain adapted to be internally inserted for use by a female. The drain connects exteriorally of the body with some type of receptacle. A singluar problem with this type of apparatus is that the wide variation in size of users of the apparatus requires virtually many different sizes of drains to be available for use. Moreover, the apparatus also requires the use of some type of external receptacle, thus requiring two individual pieces of apparatus.

U.S. Pat. No. 2,583,398 (Siegenthal) discloses what appears to be a combination of the above mentioned Hogan and Meinecke urinals, including a relatively wide, and somewhat T shaped opening, with a receptacle including a pair of flat sides, or rather one side and an adjacent bottom, which allows the apparatus to be stable in two positions.

U.S. Pat. No. 3,170,170 (Robillard) discloses a somewhat cylindrical urinal apparatus with a relatively wide rearwardly extending opening from about the mid position of the front upwardly and rearwardly to the top of the apparatus. The opening is relatively large and accordingly may be cumbersome to use by a female patient in the recumbent position.

U.S. Pat. No. 3,432,863 (Schwartz) discloses another type of internally insertable urinal apparatus.

SUMMARY OF THE INVENTION

The invention described and claimed herein comprises female urinal apparatus including a receptacle or container which is relatively narrow and relatively tall, and with inwardly sloping sides extending upwardly from the bottom. The front of the container extends upwardly and generally forwardly from the flat bottom. From the termination of the upwardly and forwardly front portion, and a relatively long and narrow opening extends upwardly and backwardly or rearwardly to the top of the apparatus. The vertically elongated apparatus is adapted to the position on a bed for use by a recumbent or supine female.

Among the objects of the present invention are the following:

To provide new and useful urinal apparatus;

To provide new and useful urinal apparatus for females;

To provide new and useful female urinal apparatus usable by females in the recumbent or supine position;

To provide new and useful urinal apparatus usable by a female in a supine position without help of an additional person; and To provide new and useful urinal apparatus for female usage which in inexpensive to manufacture and comfortable to use.

DESCRIPTION OF THE PREFERRED EMBODIMENT

Figure 1:
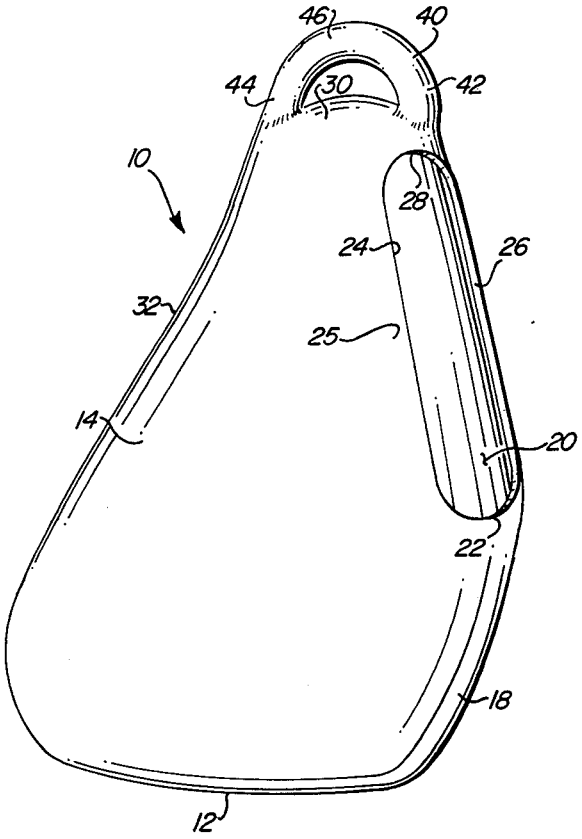
FIG. 1 is a perspective view of apparatus of the present invention generally comprising a three-quarter front view.

FIG. 1 is a perspective view of female urinal apparatus 10 of the present invention. It comprises a generally three-quarter front view. The vertically elongated apparatus 10 includes a receptacle having a generally flat, tear drop shaped bottom 12. The shape of the bottom may be ascertained most clearly from FIG. 3, since FIG. 1 is a perspective three-quarter front view which does not disclose one side of the apparatus, the back of the apparatus, or the configuration of the bottom. Extending upwardly and generally inwardly from the bottom is a side 14, illustrated in FIG. 1, and also in FIGS. 2 and 3. The side 14 tapers generally inwardly from the bottom 12 to a top portion 30, which is generally rounded. At the front portion of the apparatus, the side 14 is secured to an upwardly and outwardly sloping (toward the user) lower front wall 18. The lower front wall portion 18 is slightly rounded laterally from a center line apex rearwardly to join the respective sides, such as side 14, as shown in FIG. 1. The overall height of the front portion 18 is slightly less than about half of the overall height of the apparatus.

Above the lower front portion 18, and sloping rearwardly from the lower front portion 18 to the rounded top portion 30, is a front opening 20, which receives a flow of urine from the user of the apparatus. The front opening is defined by a somewhat outwardly extending bottom lip 22 which comprises the uppermost portion of the lower front wall 18 as well as the lowermost portion of the opening 20. Along each side of the opening are a pair or rearwardly and upwardly sloping sides or edges 24 and 26. The sides or edges 24 and 26 are not quite parallel to each other, but rather they taper slightly inwardly from the bottom lip 22. At the uppermost portion of the opening 20 is a top 28, which is rounded, similar to, but reversed from, the bottom lip 22. The sides 24 and 26 taper inwardly towards the top 28, which is slightly narrower than the bottom 22 of the opening. The bottom lip 22 and the top portion 28 are not parallel to each other, but rather are somewhat circular in configuration as they extend between the respective sides. The opening 20 entends from slightly below the half-way portion, with respect to the height of the apparatus, to adjacent the top of the apparatus. Accordingly, the opening is relatively long, somewhat narrow, and defining a generally elongated opening, tapering slightly inwardly and rearwardly, which is designed to fit the female anatomy and to accommodate female users of varied heights and sizes.

Above the upper portion 28 of the opening 20 is the top 30. Between side 24 of the opening 20 and the side 14 is a transition area 25 which comprises a rounded transition from the plane of the opening 24 to the side 14. The top is a smoothly rounded portion which extends downwardly and outwardly to join the sides 14 and 16, the back 32 of the receptacle, and the top 28 of the opening 20.

For carrying and holding the apparatus, there is a handle 40 disposed on the top 30. The handle 40 includes a front portion 42 which is secured to the top of the apparatus adjacent the top portion 28 of the opening 20. The handle terminates in a rear or back portion 44, substantially at the juncture of the top portion and the back of the apparatus. Between the front and rear or back portions of the handle is a loop 46 which extends upwardly in a gentle curve from both the front portion and the rear or back portion of the handle. By locating the handle adjacent the opening 20, a user in a recumbent or supine position may utilize the apparatus with maximum convenience. Moreover, with the apparatus configured with an upwardly and outwardly sloping lower front portion 18, an upwardly and rearwardly sloping opening 20 disposed above the front 18, and a frontwardly and upwardly extending back or rear portion, the handle 40 is disposed substantially centrally with respect to the weight of the apparatus, such that picking the apparatus up by the loop 46 of the handle allows the apparatus to maintain a normal orientation so as to prevent any spillage from the opening.

Figure 2:
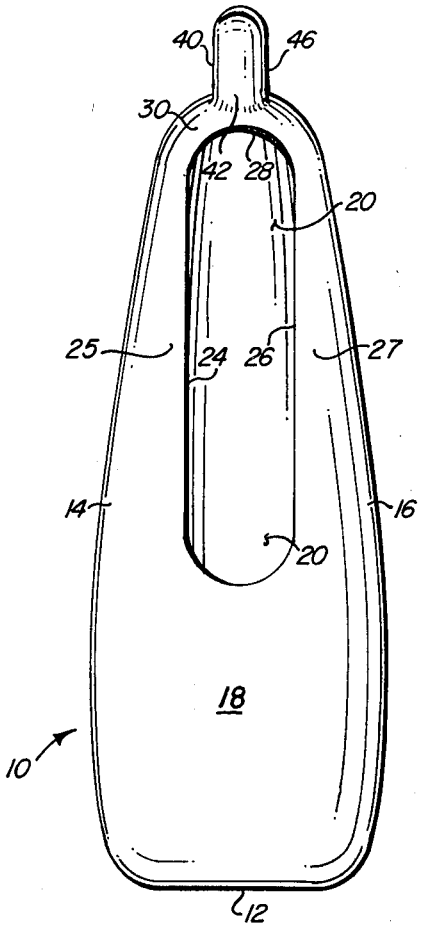
FIG. 2 is a front view of the apparatus of FIG. 1.

FIG. 2 is a front view of the female urinal apparatus 10 of FIG. 1. The upward and inward slope of sides 14 and 16 from the bottom 12 is clearly shown in FIG. 2. Moreover, the smooth curves and lack of sharp edges between the respective bottom 12, front 18, sides 14 and 16, and top 30 are also clearly shown in FIG. 2. The relative width of the apparatus varies from widest at the bottom to narrowest at the top, and also varies from narrowest at the front to widest at the back of the apparatus.

The front 18 is smoothly rounded on a relatively large radius between the sides 14 and 16. The configuration of the receptacle apparatus 10 is configured to fit the anatomy of a female user, and the front 18, when the apparatus is in use, is disposed adjacent the female, with the user's thighs disposed against the sides 14 and 16. Accordingly, the urinal apparatus or receptacle is designed to complement the general anatomical configuraion of a female user without any sharp edges or sharp demarcations between adjacent sides or surfaces. As previously indicated, the width of the front 18 is maximum adjacent the bottom 12, and is a minimum at the bottom lip 22 of the opening 20. Relative difference in width of the opening 20 is not great. The inward taper of the sides or edges 24 and 26 from the lower lip 22 to the top or upper portion 28 is slight and is preferably less than the inward taper of the walls 14 and 16.

Since the sides 14 and 16 slope inwardly and upwardly from the bottom 12, they provide the most stable configuration for the apparatus as it is used by a recumbent female in a bed. As is well known and understood, the hips and buttocks of a human being comprise the heaviest portion of the body and accordingly, when a body is in a recumbent or supine position, there is a natural and relatively gradual slope in a mattress downwardly to the hip and buttock area from both the extremities of the legs (feet) and the torso (shoulders). Since the apparatus will be disposed on a sloping mattress, the stability of the apparatus is enhanced by the sloping walls which provide a maximum surface area at the bottom and a minimum surface area at the top, in a sort of pyramidal configuration. Moreover, as the receptacle is filled, the fluid within the receptacle at the wider bottom increases the stability of the apparatus.

The handle 40 is shown connected at its front portion 42 adjacent the upper or top portion 28 of the opening 20. The user of the apparatus accordingly conveniently holds the apparatus without awkwardness to position and to steady the apparatus during use.

The smoothly rounded edges between the bottom 12 and the side 14 and 16 are also clearly illustrated in FIG. 2. The radius of the rounded edges is sufficiently large to preclude any injury or discomfort during use. As with the other edges and surfaces of the apparatus 10, the smoothly rounded edges are for convenience in using the apparatus. The term "using" refers to both use by a recumbent person and also refers to emptying and cleaning the apparatus.

Figure 3:
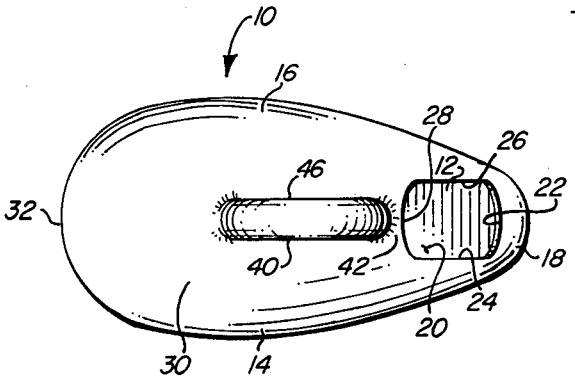
FIG. 3 is a top view of the apparatus of FIG. 1.

FIG. 3 is a view of the apparatus of FIGS. 1 and 2 from the top. The generally elongated tear drop plan configuration of the apparatus is illustrated in FIG. 3. The lower front portion 18 of the apparatus, while comprising a gently rounded portion, also comprises the front or apex of a tear drop, and the widest part of the tear drop is forward of the back 32 and at the sides 14 and 16 downwardly from about the central portion of the handle loop 46.

Looking downwardly at the apparatus in FIG. 3, and through the opening 20, the bottom 12 is shown as extending rearwardly from the lower portion of the front 18, and the bottom 12 is, of course, of a generally tear drop or pear shaped configuration, with its apex at the front 18.

Between the sides 24 and 26 of the opening 20 and the respective walls 14 and 16 are a pair of transition areas 25 and 27. The transition areas comprise smoothly rounded portions of the apparatus which extend from the opening 20 to the sides and which may be disposed against the body of the user. The transition areas are disposed above the front 18 and below the top 30.

The handle 40 appears from the top view of FIG. 3, to be generally centrally disposed with respect to the overall configuration of the urinal apparatus 10. The front portion 42 of the handle is secured to the top 30 adjacent the top or upper portion 28 of the front opening 20, and the rear or back portion 44 of the handle is secured to the top 30 adjacent the juncture of the top 30 and the back 32. The loop portion 46 extends between the front portion 42 and the rear or back portion 44 of the handle.

The back 32 is somewhat parallel to the lower front 18 with respect to its forward slope. However, the back 32 is substantially larger in extent both vertically and in width than is the lower front 18. Moreover, the lower front 18, while it has a slight vertically inward taper (see FIG. 2) from the bottom 12 to the bottom lip of the opening 20, the back 32 has a greater inward taper from adjacent the bottom 12 to where the back 32 joins the top 30.

The sides 14 and 16 comprise walls which are spaced apart a varying distance due to the general inward taper of the sides or side walls from the base 12 upwardly to the rounded top 30. The sides 14 and 16, together with the front 18 and the back 32, which are all secured together, define walls of a receptacle with a single elongated front opening 20 which extends above the front wall 18 and between the sides 24 and 26 at the respective transition areas 25 and 27, and generally remote from the back wall 32. The back wall 32 extends generally forwardly and upwardly from the bottom wall 12, which comprises the base of the apparatus, and the front wall 18 also extends upwardly and forwardly with respect to the base 12. However, the opening 20 extends backwardly or rearwardly above the front wall 18 and to the top or upper portion of the urinal apparatus 30. Accordingly, the urinal apparatus or container is enclosed at the bottom, at the lower front, at the sides, at the back and at the top, which leaves only a single opening, which is relatively long, or elongated, and narrow. The vertical elongation of the opening 20 allows the apparatus to accommodate females of various sizes.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention.

What is claimed is:

1. Female urinal receptacle apparatus, comprising, in combination:

a flat, generally tear shaped base;

first side wall means and second side wall means secured to the base and extending upwardly from the base and inwardly towards each other from the base;

a front wall secured to the base and extending upwardly and forwardly from the base and secured to and extending between the first side wall means and the second side wall means;

a back wall secured to the base and to the first and second side wall means and extending generally upwardly and forwardly from the base;

top means secured to the back wall and to the first and second side wall means;

a vertically elongated opening above the front wall and between the first and second side wall means remote from the back wall and extending upwardly and rearwardly from the front wall to the top means;

transition areas adjacent the opening extending from the opening to the first side wall means and the second side wall means; and the base, first and second side walls, front wall, back wall, opening, transition areas, and top defining a vertically elongated receptacle having an apex adjacent the front, and increasing in width toward the back to fit the female anatomy, and having a maximum width adjacent the base and a minimum width adjacent the top means to provide stability in use.

2. The apparatus of claim 1 in which the first side wall means and the second side wall means include smoothly contoured curved portions.

3. The apparatus of claim 2 in which the top means includes a handle adjacent the opening.

* * * * *